US009692168B1

(12) United States Patent
Schroll et al.

(10) Patent No.: US 9,692,168 B1
(45) Date of Patent: Jun. 27, 2017

(54) HEADER ASSEMBLY

(71) Applicant: TYCO ELECTRONICS CORPORATION, Berwyn, PA (US)

(72) Inventors: Neil Franklin Schroll, Mount Joy, PA (US); John Wesley Hall, Jr., Harrisburg, PA (US); Hurley Chester Moll, Hershey, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/072,477

(22) Filed: Mar. 17, 2016

(51) Int. Cl.

| | |
|---|---|
| ***H01R 9/05*** | (2006.01) |
| ***H01R 13/502*** | (2006.01) |
| ***H01R 24/50*** | (2011.01) |
| *H01R 103/00* | (2006.01) |

(52) U.S. Cl.
CPC ..... *H01R 13/502* (2013.01); *H01R 24/50* (2013.01); *H01R 2103/00* (2013.01)

(58) Field of Classification Search
CPC ..... H01R 13/502
USPC ..... 439/578, 607.35, 63, 62, 620.03
See application file for complete search history.

(56) References Cited

U.S. PATENT DOCUMENTS

| | | | | |
|---|---|---|---|---|
| 5,046,952 | A * | 9/1991 | Cohen | H01R 12/727 439/63 |
| 6,099,350 | A * | 8/2000 | Wright | H01R 13/627 439/352 |
| 6,386,888 | B1 * | 5/2002 | Skopic | H01R 24/50 439/581 |
| 6,824,403 | B2 * | 11/2004 | Hall | H01R 24/50 439/101 |
| 7,029,286 | B2 * | 4/2006 | Hall | H01R 13/506 439/357 |
| 7,326,063 | B1 | 2/2008 | Raudenbush et al. | |
| 7,682,205 | B2 * | 3/2010 | Hall | H01R 13/4361 439/752 |
| 8,277,248 | B2 * | 10/2012 | Blakborn | H01R 13/41 439/581 |
| 8,430,675 | B2 * | 4/2013 | Hardy | H01R 24/50 439/607.36 |
| 8,500,486 | B2 * | 8/2013 | Buck | H01R 13/74 439/551 |
| 8,740,629 | B1 * | 6/2014 | Hall | H01R 13/6456 439/63 |
| 8,790,136 | B2 * | 7/2014 | Duesterhoeft | H01R 13/6583 439/101 |
| 9,391,409 | B2 * | 7/2016 | Abe | H01R 13/6582 |
| 2013/0309904 | A1 * | 11/2013 | Hall | H01R 12/57 439/578 |

* cited by examiner

*Primary Examiner* — Tulsidas C Patel
*Assistant Examiner* — Peter G Leigh

(57) ABSTRACT

A header assembly includes a dielectric housing, an electrically conductive outer contact, and a center contact. The housing has a front panel that defines a contact opening therethrough between a front side and a rear side of the front panel. The housing also includes a base panel extending from the rear side of the front panel. The base panel mounts to a circuit board. The outer contact includes a mating segment that extends through the contact opening of the housing and defines a channel that receives the center contact therein. The outer contact also includes a mounting segment that engages the base panel of the housing and is disposed between the base panel and the circuit board. The mounting segment couples and electrically terminates to the circuit board.

20 Claims, 6 Drawing Sheets

HEADER ASSEMBLY

BACKGROUND OF THE INVENTION

The subject matter herein relates generally to header assemblies.

Radio frequency (RF) coaxial connector assemblies have been used for numerous automotive applications, such as global positioning systems (GPS), car radios, mobile phones, air bag systems, and multimedia devices. Some coaxial connector assemblies are cable assemblies that are terminated to ends of coaxial cables. Coaxial cables typically consist of an outer conductor, an inner conductor, a dielectric, and a jacket or outer insulation. The outer conductor and the inner conductor of the cable electrically interface with corresponding inner and outer contacts of the connector, which may be a male or a female connector. Other coaxial connector assemblies are terminated to a circuit board rather than a cable. To interface with coaxial cable assemblies, such board-mounted assemblies include a coaxial interface defined by a center contact and an outer contact surrounding the center contact. Both the center and outer contacts terminate to the circuit board.

In order to standardize various types of connectors and thereby avoid confusion, certain industry standards have been established. One of these standards is referred to as FAKRA. FAKRA is the Automotive Standards Committee in the German Institute for Standardization, representing international standardization interests in the automotive field. The FAKRA standard provides a system, based on keying and color coding, for proper connector attachment. The keying and color identifying features of a FAKRA connector are typically on a housing. Male keying features can only be connected to like female keyways in FAKRA connector assemblies. Secure positioning and locking of connector housings is facilitated by way of a FAKRA defined catch on the male housing and a cooperating latch on the female housing.

Typical product families of FAKRA connectors include die-cast parts. For example, a header connector may include a die-cast shield component that includes an integral cylindrical outer contact which surrounds a center conductor to provide shielding and a grounding path. The die-cast shield component also may include a housing structure that mounts to a circuit board in order to provide electrical grounding and/or structural support for the header connector. Such known header connectors are not without disadvantages, however, as die-casting the shield component and/or other parts can be expensive and time-inefficient. An alternative to die-casting is stamping and forming one or more shield components out of a conductive panel, which may be more cost efficient than die-casting. However, stamped and formed shield components are generally not as strong structurally as die-cast parts, so stamping and forming the shield components of known FAKRA connector systems may result the in the components deforming (for example, bending) and/or breaking in response to mating and un-mating forces applied on the components. A need remains for a header assembly with shield components that are more cost efficient than die-cast parts and provide greater structural strength and resiliency than known stamped and formed parts.

BRIEF DESCRIPTION OF THE INVENTION

In an embodiment, a header assembly is provided that includes a housing, an outer contact, and a center contact.

The housing is composed of a dielectric material. The housing has a front panel including a front side and a rear side. The front panel defines a contact opening therethrough between the front side and the rear side. The housing also includes a base panel extending from the rear side of the front panel. The base panel is configured to mount to a circuit board. The outer contact is formed of an electrically conductive material. The outer contact includes a mating segment and a mounting segment. The mating segment extends through the contact opening of the front panel and defines a cylindrically-shaped channel. The mounting segment engages the base panel and is disposed between the base panel and the circuit board. The mounting segment is configured to mechanically couple and electrically terminate to the circuit board. The center contact is disposed in the channel of the outer contact.

In another embodiment, a header assembly is provided that includes a housing, an outer contact, and a center contact. The housing is composed of a dielectric material. The housing has a front panel including a front side and a rear side. The front panel defines a contact opening therethrough between the front side and the rear side. The housing also includes a base panel extending from the rear side of the front panel. The base panel defines a tunnel that extends rearward from a front of the base panel at the front panel. The base panel is configured to mount to a circuit board. The outer contact is formed of an electrically conductive material. The outer contact includes a mating segment and a mounting segment. The mating segment extends through the contact opening of the front panel and defines a cylindrically-shaped channel. The mounting segment is disposed within the tunnel of the base panel between an inner surface of the tunnel and the circuit board. The mounting segment is configured to mechanically couple and electrically terminate to the circuit board. The center contact is disposed in the channel of the outer contact.

In yet another embodiment, a header assembly is provided that includes a housing, a nose cone, and an outer contact. The housing is composed of a dielectric material. The housing has a front panel including a front side and a rear side. The front panel defines a contact opening therethrough between the front side and the rear side. The housing also includes a base panel extending from the rear side of the front panel. The base panel is configured to mount to a circuit board. The nose cone is coupled to the front panel and extends frontward from the front side of the front panel along a mating axis. The nose cone defines a cavity that aligns with and is open to the contact opening. The nose cone defines a mating interface for receiving a mating connector within the cavity in a loading direction along the mating axis. The nose cone has at least one keying rib along an exterior thereof. The outer contact is formed of an electrically conductive material. The outer contact extends longitudinally from a mating segment to a mounting segment. The mating segment is disposed within the cavity of the nose cone and extends through the contact opening of the front panel. The mounting segment is disposed rearward of the front panel and is located between the base panel and the circuit board. The mounting segment is configured to mechanically couple and electrically terminate to the circuit board.

DETAILED DESCRIPTION OF THE INVENTION

One or more embodiments described herein are directed to a coaxial header assembly configured to be mounted to a circuit board. The header assembly is configured for electrically connecting a mating electrical connector to the circuit board. The header assembly may be a FAKRA-style connector assembly. The header assembly may include a stamped and formed outer contact that electrically terminates to the circuit board. The header assembly also includes a housing that engages and supports the outer contact in order to provide structural support for the outer contact to resist deformation and/or breaking due to mating and unmating forces applied on the outer contact. The header assembly may avoid using at least some of the die-cast components installed in known header connectors. Optionally, the header assembly does not include any die-case components. Since die-casting may be more expensive than other manufacturing processes, such as stamping and forming, the header assembly may be more cost efficient than at least some known header connectors that incorporate die-cast components.

Figure 1:
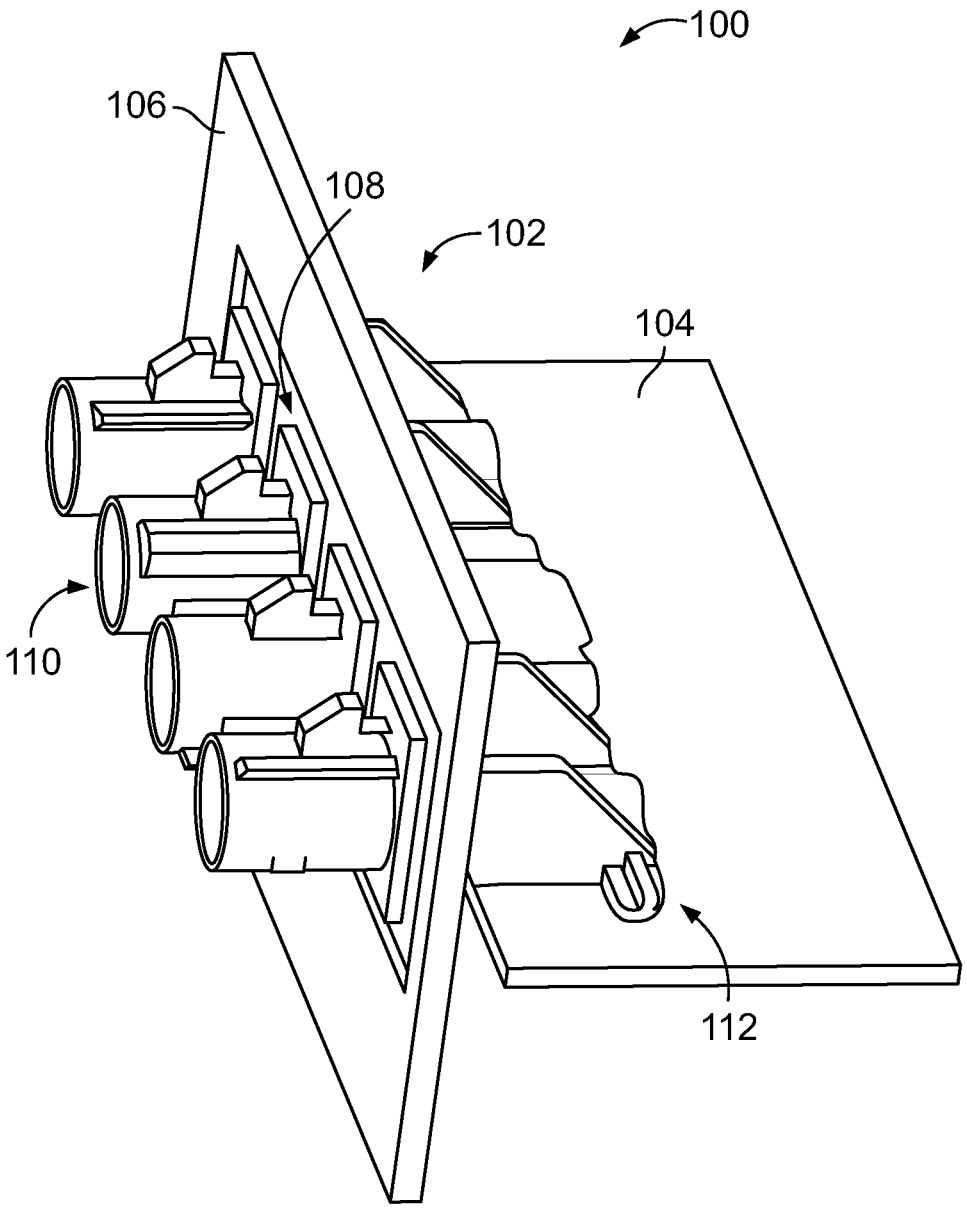
FIG. 1 is a front perspective view of a connector system formed in accordance with an embodiment.

FIG. 1 is a front perspective view of a connector system 100 formed in accordance with an embodiment. The connector system 100 includes at least a coaxial header assembly 102, a circuit board 104, and a panel 106 of a device (not shown). The connector system 100 may be mounted in the device, such as a radio, having a casing that houses components of a communication system. The panel 106 may be a wall of the casing of the device. The panel 106 defines one or more windows 108 through which at least a portion of the header assembly 102 extends. A single window 108 is shown in FIG. 1. The window 108 may be sized to receive the corresponding portion of the header assembly 102. In the illustrated embodiment, the header assembly 102 includes a mating end 110 and a mounting end 112. The mounting end 112 of the header assembly 102 is within the casing and is interior of the panel 106. The mating end 110 extends through the window 108 and is exterior of the panel 106. The mating end 110 is exterior of the panel 106 for mating with a corresponding mating connector (not shown).

The circuit board 104 on which the header assembly 102 is mounted may form part of a communication system, such as for an automotive vehicle. For example, the communication system may be used in an automotive application, such as a global positioning system (GPS), car radio, mobile phone, rear-view camera, air bag system, multimedia device system, and the like. The communication system may have use in other types of applications such as aeronautic applications, marine applications, military applications, industrial applications, and the like. The circuit board 104 may form part of an antenna. The circuit board 104 may form part of a radio frequency (RF) system.

In the illustrated embodiment, the header assembly 102 constitutes a male assembly that is configured to be mated with a corresponding female mating connector (not shown). In an embodiment, the header assembly 102 is a standardized connector, such as a FAKRA standardized connector. The header assembly 102 has features designed according to desired FAKRA specifications. For example, the header assembly 102 may have certain keying configurations for restricting the mate-ability of the header assembly 102 to one or more specific mating connectors. In an alternative embodiment, the header assembly 102 may constitute a female assembly that is configured to be mated to a corresponding male mating connector.

Figure 2:
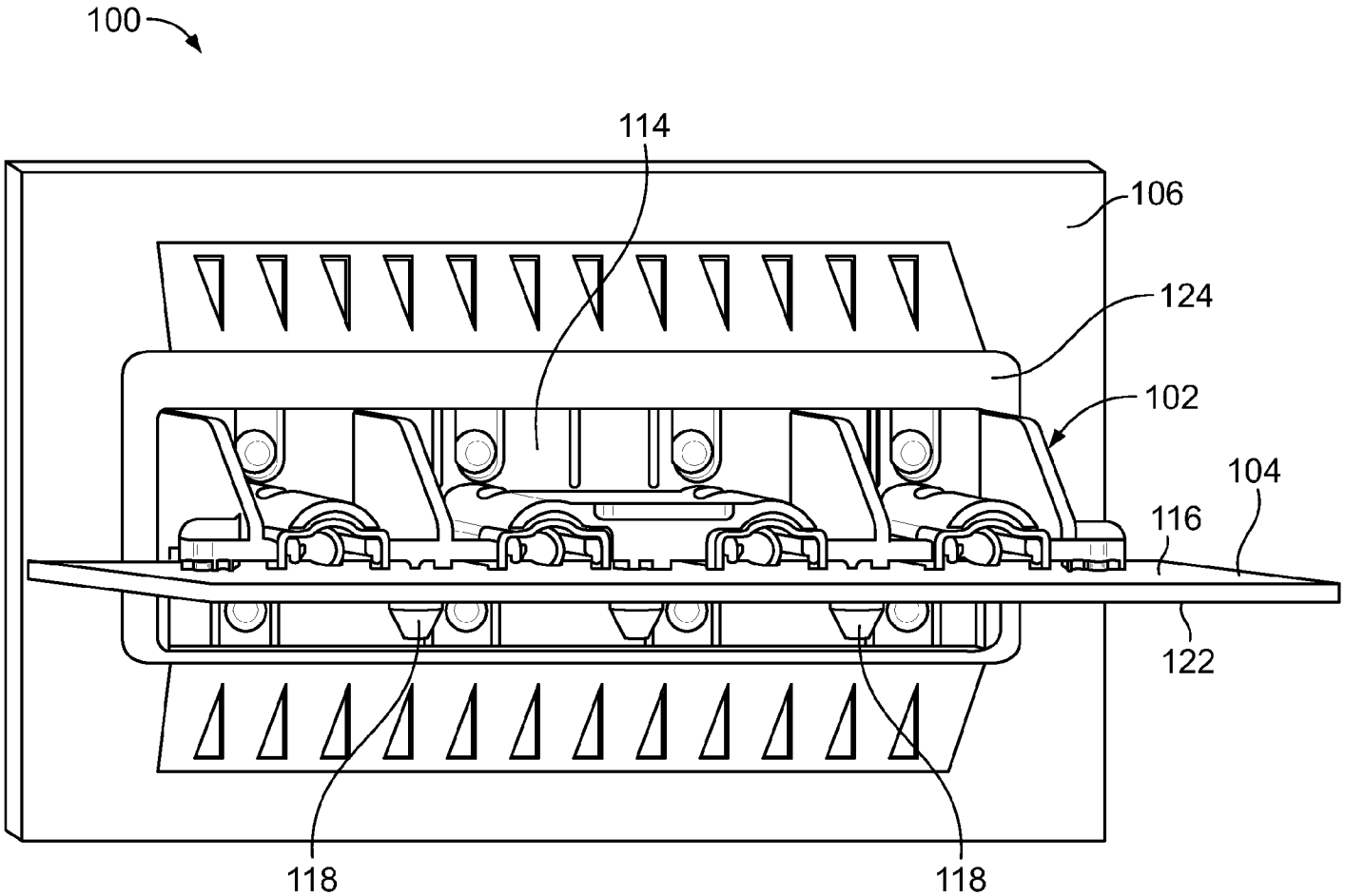
FIG. 2 is a rear perspective view of the connector system.

FIG. 2 is a rear perspective view of the connector system 100 shown in FIG. 1. FIG. 2 shows the portions of the header assembly 102 that are interior of the panel 106 within the casing. The header assembly 102 includes a housing 114 that is secured to the circuit board 104. In the illustrated embodiment, the housing 114 is through-hole mounted to a top side 116 of the circuit board 104. For example, the housing 114 includes mounting posts 118 that extend into corresponding holes 120 (shown in FIG. 7) of the circuit board 104. In the illustrated embodiment, the mounting posts 118 extend fully through the circuit board 104 and protrude beyond an opposite bottom side 122 of the circuit board 104. As used herein, relative or spatial terms such as "top," "bottom," "front," "rear," "left," and "right" are only used to distinguish the referenced elements and do not necessarily require particular positions or orientations relative to gravity and/or the surrounding environment of the connector system 100. In other embodiments, the housing 114 may be secured to the circuit board 104 via external fasteners (such as clips, screws, bolts, etc.), adhesives, or the like.

Optionally, the header assembly 102 includes an electromagnetic interference (EMI) shield 124. The EMI shield 124 may be used to provide shielding at the window 108 (shown in FIG. 1) of the panel 106 through which the mating end 110 of the header assembly 102 is loaded. For example, the window 108 may be sized larger than the portion of the header assembly 102 extending through the window 108, leaving a gap between the edges of the panel 106 and the header assembly 102. The EMI shield 124 is configured to cover the gap to prohibit EMI transmission through the window 108. The EMI shield 124 may also be used to electrically connect the header assembly 102 to the panel 106 of the casing. For example, the EMI shield 124 may create a direct electrical path between the panel 106 and the header assembly 102.

Figure 3:
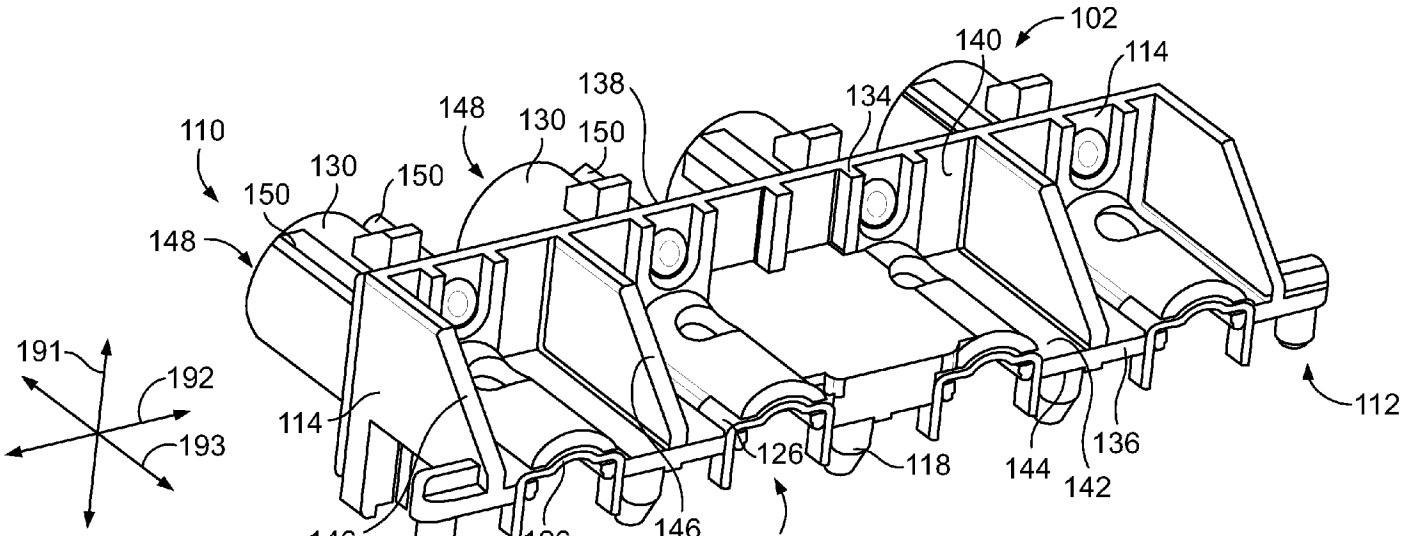
FIG. 3 is a rear perspective view of a header assembly of the connector system according to an embodiment.
Figure 6:
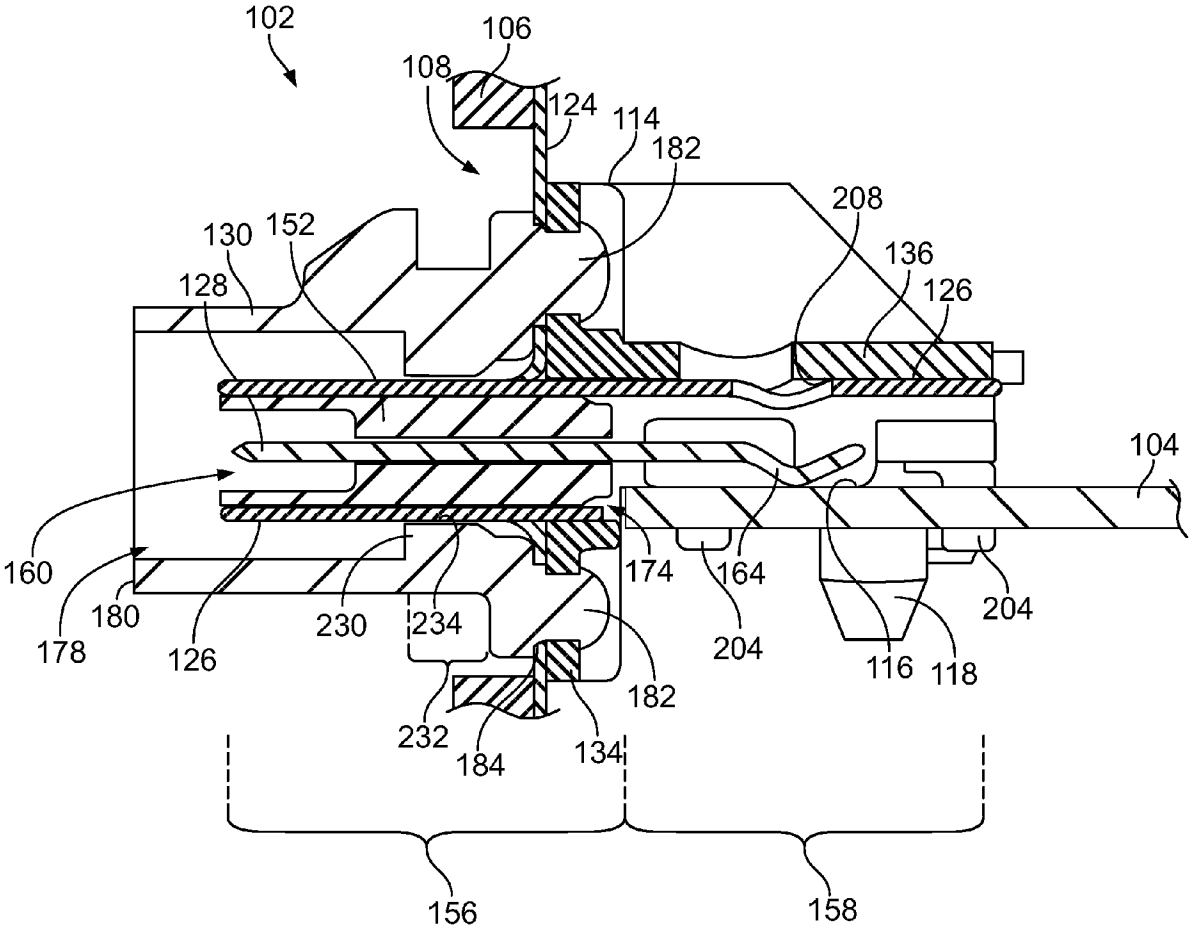
FIG. 6 is a cross-sectional view of the header assembly mounted to a circuit board according to an embodiment.

FIG. 3 is a rear perspective view of the header assembly 102 according to an embodiment. The header assembly 102 includes the housing 114, at least one outer contact 126, at least one center contact 128 (shown in FIG. 4), and at least one nose cone 130. The EMI shield 124 is not shown in FIG. 3. The header assembly 102 in an embodiment is a coaxial connector, such that the center contact 128 and the outer contact 126 are coaxial electrical conductors. The center contact 128 and the outer contact 126 are configured to engage and electrically connect to corresponding mating contacts of the mating connector. As shown in FIG. 6, the center contact 128 is disposed within and surrounded by the outer contact 126. The outer contact 126 is configured to be terminated or electrically connected to the circuit board 104 (shown in FIG. 2) to provide an electrical grounding path between the outer contact 126 and the circuit board 104. The outer contact 126 is also configured to be mechanically secured to the circuit board 104 to structurally support the outer contact 126 and hold the outer contact 126 in position during mating and un-mating operations of the mating connector.

The header assembly 102 is oriented with respect to a vertical or elevation axis 191, a lateral axis 192, and a longitudinal or mating axis 193. The axes 191-193 are mutually perpendicular. Although the elevation axis 191 appears to extend generally parallel to gravity, it is understood that the axes 191-193 are not required to have any particular orientation with respect to gravity. The mating connector is configured to be mated to the mating end 110 of the header assembly 102 by moving the mating connector towards the header assembly 102 in a loading direction that is parallel to the mating axis 193.

The header assembly 102 may have any number of center contacts 128, outer contacts 126, and nose cones 130 that are held by the housing 114. For example, the housing 114 extends a width along the lateral axis 192. The header assembly 102 may include multiple nose cones 130 disposed side-by-side along the width of the housing 114. The header assembly 102 also includes multiple sets 132 of outer contacts 126 and center contacts 128 (shown in FIG. 4) disposed side-by-side along the width of the housing 114, such that each set 132 includes an outer contact 126 and a center contact 128. Each set 132 aligns with a one of the nose cones 130. In the illustrated embodiment, the header assembly 102 includes four nose cones 130 and four sets 132 of contacts 126, 128 held by the housing 114. The different sets 132 of contacts 126, 128 may be approximately identical or at least similar to each other, such that the outer contacts 126 of different sets 132 are formed using the same materials and processes to have the same sizes and shapes. In other embodiments, the header assembly 102 may include more or less than four nose cones 130 and sets 132. For example, the header assembly 102 could have only one nose cone 130 and only one set 132 of contacts 126, 128. In the illustrated embodiment, the nose cones 130 are discrete components that are not connected to each other, but in an alternative embodiment at least two of the nose cones 130 may be formed integral with each other as a single unitary component.

The housing 114 includes a front panel 134 and a base panel 136. The front panel 134 has a front side 138 and a rear side 140. The base panel 136 extends from the rear side 140 of the front panel 134. The base panel 136 is angled relative to the front panel 134 and defines a top side 142 and an opposite bottom side 144. The base panel 136 defines at least a portion of the mounting end 112 of the header assembly 102. For example, the bottom side 144 faces the circuit board 104 (shown in FIG. 2). The mounting posts 118 extend from the bottom side 144 of the base panel 136 to engage the circuit board 104. In an embodiment, the base panel 136 extends generally perpendicular to a plane of the front panel 134. Alternatively, the base panel 136 may extend at an oblique angle relative to the front panel 134. The housing 114 also includes at least one support wall 146 that extends between the front panel 134 and the base panel 136. The illustrated embodiment includes four support walls 146. The support walls 146 are configured to provide structural stability to retain the designated angle between the front panel 134 and the base panel 136. Thus, the support walls 146 are configured to prohibit the front panel 134 from deforming, such as bending or twisting, relative to the base panel 136 that is secured to the circuit board 104 via the mounting posts 118.

The nose cones 130 are coupled to the front panel 134 and extend from the front side 138 of the front panel 134. The nose cones 130 extend from the front panel 134 parallel to the mating axis 193. Each nose cone 130 defines a mating interface 148 for engaging a mating connector. For example, a portion of the mating connector may be received within a corresponding nose cone 130 and/or may engage and at least partially surround an exterior surface of the nose cone 130 at the mating interface 148. Optionally, each of the nose cones 130 may engage a different portion of a single mating connector, or at least some of the nose cones 130 of the header assembly 102 may be configured to engage different mating connectors. For example, the header assembly 102 shown in FIG. 3 may be configured to engage four different mating connectors or may engage less than four different mating connectors if at least one mating connector is configured to engage the mating interfaces 148 of at least two of the nose cones 130.

In an embodiment, the mating end 110 of the header assembly 102 may define a FAKRA compliant connector such that the mating interfaces 148 of the nose cones 130 are keyed according to FAKRA specifications. For example, the nose cones 130 include keying ribs 150 on exterior surfaces thereof. The size, shape, and/or orientation of the keying ribs 150 may be used to define the different FAKRA interfaces 148. For example, the four nose cones 130 shown in FIG. 3 may have different interfaces 148 defined by different shapes, numbers, and/or locations of keying ribs 150. The nose cones 130 optionally have color or another type of visual identification. In an alternative embodiment, the header assembly 102 may be designed to different standards or to mate with a different type of mating connector.

Figure 4:
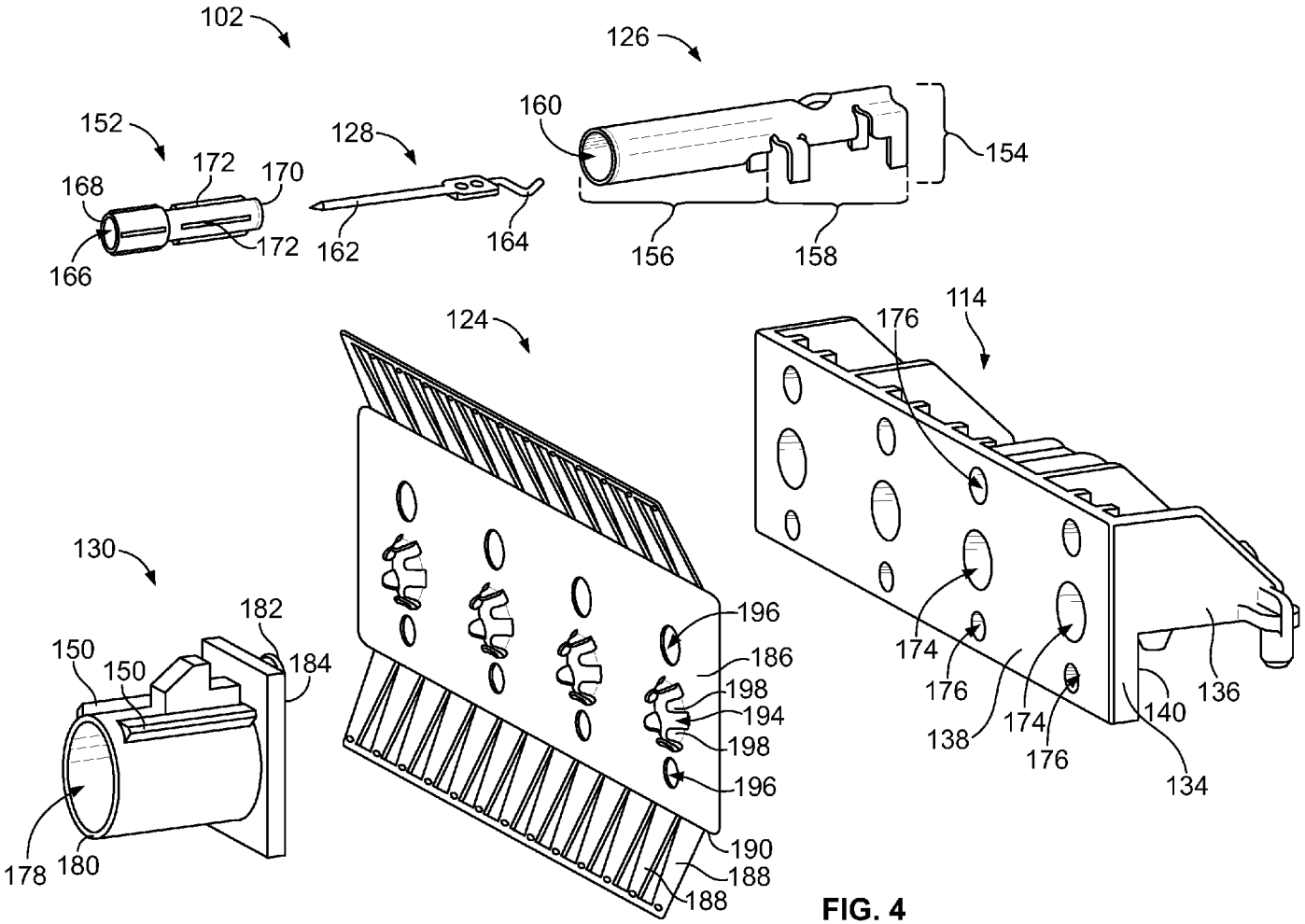
FIG. 4 is an exploded front perspective view of the header assembly according to an embodiment.

FIG. 4 is an exploded front perspective view of the header assembly 102 according to an embodiment. The illustrated components of the header assembly 102 include the housing 114, the EMI shield 124, one nose cone 130, one outer contact 126, one center contact 128, and a dielectric insert 152. The outer contact 126, dielectric insert 152, and center contact 128 define a contact subassembly 154. Only one nose cone 130 is shown in FIG. 4 because the other nose cones 130 (shown in FIG. 3) may be similar to the illustrated nose cone 130 except for the arrangement of the keying ribs 150. Only one contact subassembly 154 is shown in FIG. 4 because all contact subassemblies in the header assembly 102 may be identical or at least similar to the illustrated contact subassembly 154.

The outer contact 126 is composed of at least one electrically conductive material, such as copper, silver, aluminum, a combination of metals including at least one of copper, silver, and aluminum, and/or the like. The outer contact 126 is electrically conductive, and may be used to provide an electrical signal path, such as for grounding or transmitting signals. In an embodiment, the outer contact 126 is manufactured by stamping and forming a sheet of metal into a desired shape. In an alternative embodiment, the outer contact 126 may be formed via another process, such as die-casting or another molding process. The outer contact 126 extends longitudinally and includes a mating segment 156 and a mounting segment 158. The mating segment 156 is disposed adjacent to the mounting segment 158 along the length of the outer contact 126. The mating segment 156 and the mounting segment 158 may together define the entire length of the outer contact 126. The mating segment 156 has a closed cylindrical shape and defines a cylindrically-shaped channel 160. The mounting segment 158 has an open cylindrical shape in the illustrated embodiment. The mating segment 156 and the mounting segment 158 may be formed integral to one another, such as during a common stamping and forming process.

Figure 5:
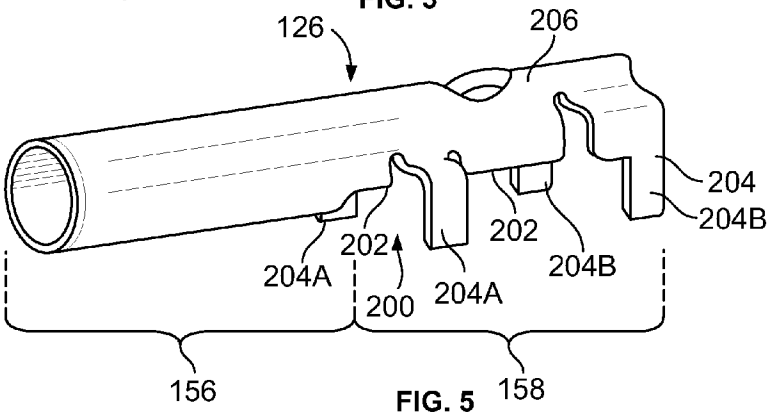
FIG. 5 is a perspective view of an outer contact of the header assembly according to an embodiment.

FIG. 5 is a perspective view of the outer contact 126 according to an embodiment. The mounting segment 158 has an open cylindrical shape that is open along a bottom 200 thereof. The open bottom 200 is at least partially defined by edges 202 of the outer contact 126. The outer contact 126 further includes grounding legs 204 that extend from the edges 202 along the mounting segment 158. The grounding legs 204 extend outward from a spine portion 206 of the outer contact 126. The spine portion 206 is between the edges 202. The grounding legs 204 are configured to be mechanically coupled to the circuit board 104 (shown in FIG. 2) and electrically terminated to the circuit board 104. Thus, the grounding legs 204 mount the outer contact 126 to the circuit board 104 and also provide an electrical grounding path that electrically connects the outer contact 126 to the circuit board 104. In the illustrated embodiment, the outer contact 126 includes four grounding legs 204, including two front grounding legs 204A and two rear grounding legs 204B. The front grounding legs 204A are located more proximate to the mating segment 156 than the location of the rear grounding legs 204B to the mating segment 156. In an embodiment, the grounding legs 204 are formed integral to the outer contact 126. For example, the grounding legs 204 may be stamped and formed with the outer contact 126 as a unitary, one-piece component.

Referring now back to FIG. 4, the center contact 128 is composed of at least one electrically conductive material, such as copper, silver, aluminum, a combination of metals including at least one of copper, silver, and aluminum, and/or the like. The center contact 128 is electrically conductive, and may be used to provide an electrical signal path, such as for transmitting signals. The center contact 128 may be formed by stamping and optionally forming. For example, the center contact 128 may be flat and planar such that a forming step after stamping is not necessary. In another embodiment, the center contact 128 may be molded. The center contact 128 may define a pin 162 and a tail 164. The pin 162 is configured to engage a corresponding mating contact of the mating connector, and the tail 164 is configured to be electrically terminated to the circuit board 104 (shown in FIG. 2), such as via through-hole mounting or surface mounting. The tail 164 in the illustrated embodiment is configured to be surface mounted to the circuit board 104 via soldering or the like.

The dielectric insert 152 is composed of a dielectric material, such as one or more plastics. The dielectric insert 152 extends longitudinally and defines an opening 166 extending the length of the insert 152 between a front end 168 and a rear end 170 thereof. The center contact 128 is received within the opening 166 of the dielectric insert 152 when the contact subassembly 154 is assembled. The dielectric insert 152 is configured to be received within the channel 160 of the outer contact 126 during the assembly of the contact subassembly 154. The dielectric insert 152 may include interference (or crush) ribs 172 along an exterior surface thereof for engaging an interior surface of the outer contact 126 that defines the channel 160. The interference ribs 172 are configured to increase friction between the dielectric insert 152 and the outer contact 126 to increase the force required to move the dielectric insert 152 relative to the outer contact 126. Therefore, when the contact subassembly 154 is assembled, the dielectric insert 152 surrounds the center contact 128 and is surrounded by the outer contact 126. The dielectric insert 152 extends between the contacts 126, 128 and electrically insulates the contact 126, 128 from one another.

The housing 114 is composed of a dielectric material, such as one or more plastics. The housing 114 may be manufactured via a molding process. The front panel 134 may be formed integral to the base panel 136 during a common molding process such that the housing 114 is a single, unitary component. In an alternative embodiment, the housing 114 may be an assembly of multiple discrete components coupled together. The front side 138 of the front panel 134 is shown in FIG. 4. The front panel 134 defines at least one contact opening 174 therethrough between the front side 138 and the rear side 140. Each contact opening 174 is configured to receive the mating segment 156 of an outer contact 126 therethrough. The pin 162 of the center contact 128 and the dielectric insert 152 disposed in the channel 160 of the outer contact 126 also extend through the contact opening 174. For example, the mounting segment 158 of each outer contact 126 is disposed rearward of the rear side 140 of the front panel 134. The mating segment 156 of the outer contact 126 extends through the corresponding contact opening 174 such that at least a portion (e.g., most) of the mating segment 156 is disposed frontward of the front side 138, as shown in FIG. 6. In the illustrated embodiment, the housing 114 defines four contact openings 174 spaced apart along the lateral width of the housing 114 to allow the housing 114 to hold four contact subassemblies 154.

In an embodiment, the housing 114 also defines at least one aperture 176 that is associated with each contact opening 174. In the illustrated embodiment, the housing 114 defines two apertures 176 proximate to each contact opening 174. One of the two apertures 176 is located vertically above the corresponding contact opening 174 (along the vertical axis 191 shown in FIG. 3), and the other aperture 176 is located vertically below the corresponding contact opening 174. Each aperture 176 extends at least partially through the front panel 134. For example, the apertures 176 may extend fully through the front panel 134 between the front and rear sides 138, 140.

The nose cone 130 may be composed of a dielectric material, such as one or more plastics. The nose cone 130 optionally may be formed via a molding process. The nose cone 130 defines a cavity 178 that extends into the nose cone 130 from a front end 180 thereof. The cavity 178 aligns with one of the contact openings 174 when the nose cone 130 is coupled to the housing 114. The portion of the mating segment 156 of the outer contact 126 that protrudes from the front side 138 of the front panel 134 is received within the cavity 178. Thus, the nose cone 130 surrounds the portion of the contact subassembly 154 that protrudes frontward from the front panel 134 generally along the mating axis 193 (shown in FIG. 3). The nose cone 130 includes two keying ribs 150 in the illustrated embodiment.

The nose cone 130 couples to the front panel 134 of the housing 114. For example, the nose cone 130 may include at least one lug 182 that extends rearward from a back wall 184 of the nose cone 130. Each lug 182 is configured to be received in a corresponding aperture 176 in the front panel 134. The nose cone 130 in the illustrated embodiment includes two lugs 182, but only one lug 182 is visible. The lugs 182 may be formed integral to the nose cone 130 as a discrete unitary component. The lugs 182 may be inserted into the corresponding apertures 176, such as via cold-staking, in order to secure the nose cone 130 to the front panel 134. Optionally, the lugs 182 may include a flange that compresses and/or deflects upon insertion and resiliently returns towards an uncompressed or undeflected state upon protruding beyond the rear side 140 to provide a mechanical lock. In other embodiments, the nose cone 130 may be coupled to the front panel 134 via an external fastener, such as a bolt or screw, an adhesive, or the like.

The EMI shield 124 in an embodiment is disposed between the nose cone 130 and the housing 114. The EMI shield 124 is composed of an electrically conductive material, such as one or more metals. The EMI shield 124 includes a plate 186 and spring fingers 188 extending from outer edges 190 of the plate 186. The spring fingers 188 are configured to engage the panel 106 (shown in FIG. 1) to apply a biasing force against the panel 106. The plate 186 defines contact holes 194 that align with the contact openings 174 and are size and shaped to receive the contact subassembly 154 therethrough. The plate 186 also defining lug holes 196 that align with the apertures 176 and are sized and shaped to receive the lugs 182 therethrough. In the illustrated embodiment, the EMI shield 124 includes deflectable tabs 198 that extend at least partially into the contact holes 194. The deflectable tabs 198 are configured to mechanically engage the mating segment 156 of the outer contact 126 that extends through the respective contact hole 194 to electrical connect the EMI shield 124 to the outer contact 126.

FIG. 6 is a cross-sectional view of the header assembly 102 mounted to the circuit board 104 according to an embodiment. The center contact 128 and the dielectric insert 152 are held within the channel 160 of the outer contact 126. The nose cone 130 is coupled to the front panel 134 of the housing 114 via the lugs 182. The cavity 178 of the nose cone 130 aligns with and is open to the contact opening 174 of the front panel 134. The mating segment 156 of the outer contact 126, and the portions of the center contact 128 and the dielectric insert 152 therein, extend into the cavity 178 in order to electrically connect to mating contacts of the mating connector. The tail 164 of the center contact 128 engages the top side 116 of the circuit board 104. The tail 164 may be surface mounted to the circuit board 104, such as via soldering, to electrically connect the center contact 128 to the circuit board 104. The EMI shield 124 is disposed between the nose cone 130 and the front panel 134. The EMI shield 124 covers the gap between the header assembly 102 and the panel 106 of the casing in the window 108 of the panel 106.

The nose cone 130 may provide structural support for the mating segment 156 of the outer contact 126, such as to prohibit the mating segment 156 from bending and twisting during mating and un-mating of the mating connector. For example, the nose cone 130 defines an annular shoulder 230 within the cavity 178. The annular shoulder 230 defines a reduced-diameter portion 232 of the cavity 178. The reduced-diameter portion 232 is more proximate to the back wall 184 of the nose cone 130 than to the front end 180 of the nose cone 130. An interior surface 234 of the annular shoulder 230 surrounds the mating segment 156 of the outer contact 126. The diameter of the reduced-diameter portion 232 may be equal to an outer diameter of the outer contact 126 within the cavity 178 such that the interior surface 234 constantly engages an exterior surface of the outer contact 126. Alternatively, the diameter of the reduced-diameter portion 232 may be at least slightly greater than the outer diameter of the outer contact 126 such that the interior surface 234 may not constantly engage the outer contact 126. The interior surface 234 of the annular shoulder 230 may provide a hard stop that surrounds the outer contact 126 to block the outer contact 126 from bending during mating and/or un-mating of the mating connector. Depending on the relative diameters of the outer contact 126 and the reduced-diameter portion 232 along the annular shoulder 230, the annular shoulder 230 may prohibit the mating segment 156 from any bending or from bending beyond a designated allowable threshold. The nose cone 130 is structurally secured to the housing 114 via the lugs 182, and the housing 114 is structurally secured to the circuit board 104 via the mounting posts 118. Thus, the annular shoulder 230 of the nose cone 130 may structurally tie the mating segment 156 of the outer contact 126 to the circuit board 104 through the housing 114.

In an embodiment, the mounting segment 158 of the outer contact 126 is disposed between the base panel 136 of the housing 114 and the circuit board 104. For example, the base panel 136 extends over (or above) the mounting segment 158 and the circuit board 104 extends under (or below) the mounting segment 158. The circuit board 104 may extend under all portions of the mounting segment 158 except for the portions of the grounding legs 204 of the mounting segment 158 that extend through the circuit board 104 for mounting the outer contact 126. The mounting segment 158 of the outer contact 126 may engage an inner surface 208 the base panel 136 that faces the circuit board 104. The base panel 136 of the housing 114 is independently mounted to the circuit board 104 via the mounting posts 118, so the engagement between the base panel 136 and the mounting segment 158 of the outer contact 126 may structurally reinforce the outer contact 126 to prohibit the outer contact 126 from bending, twisting, and/or breaking during mating or un-mating of the mating connector. The engagement between the base panel 136 of the housing 114 and the mounting segment 158 of the outer contact 126 may also mechanically reinforce the mounting of the outer contact 126 to the circuit board 104 by mechanically blocking the mounting segment 158 from lifting up from the top side 116 of the circuit board 104.

Figure 7:
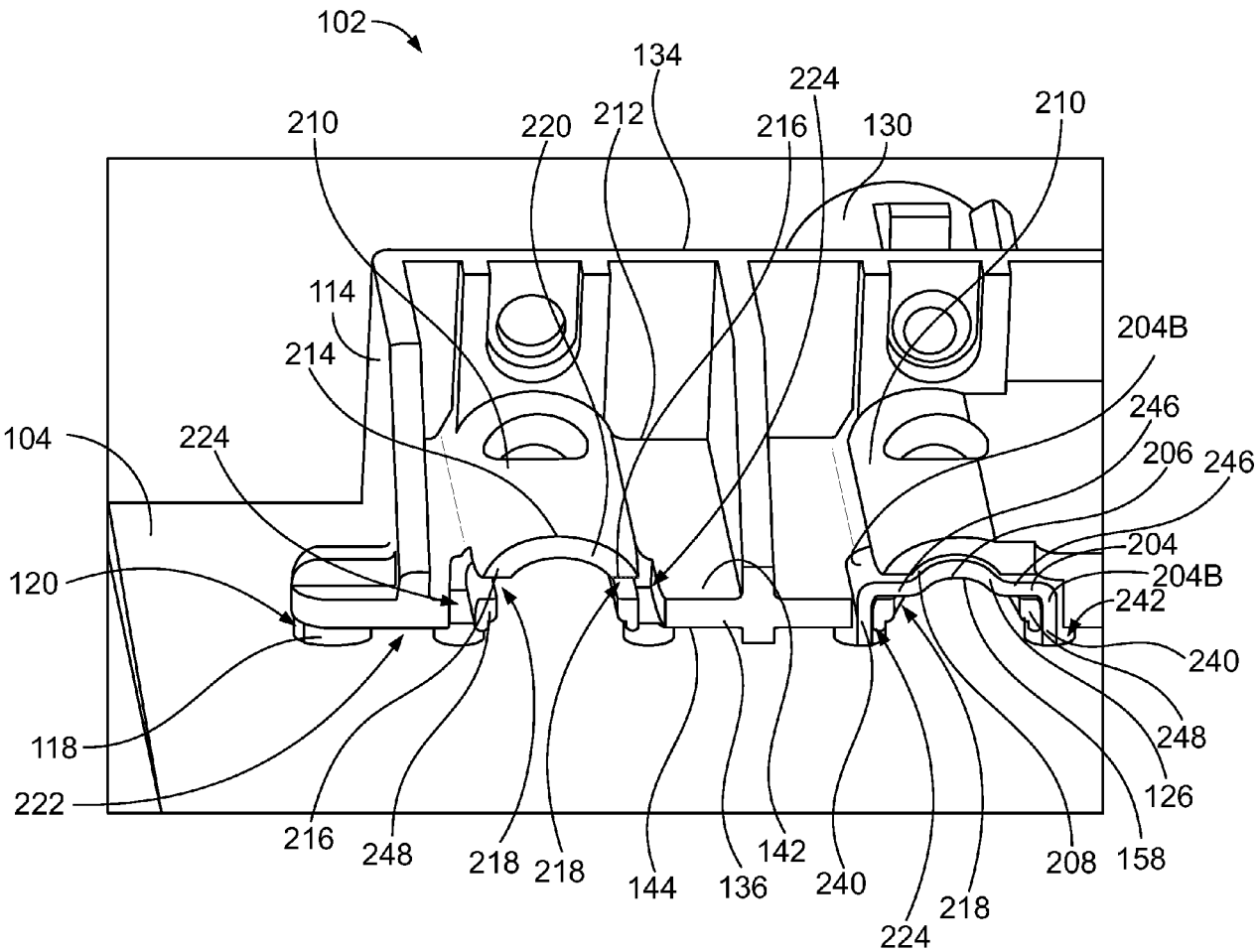
FIG. 7 is a rear perspective view of a portion of the header assembly mounted to the circuit board according to an embodiment.

FIG. 7 is a rear perspective view of a portion of the header assembly 102 mounted to the circuit board 104 according to an embodiment. The base panel 136 of the housing 114 defines at least one tunnel 210 that extends rearward from a front 212 of the base panel 136. The front 212 of the base panel 136 is at the front panel 134. Two tunnels 210 are shown in the illustrated portion of the header assembly 102. Each tunnel 210 is configured to be aligned and associated with a corresponding contact subassembly 154 (shown in FIG. 4) and a corresponding nose cone 130. In order to illustrate certain aspects of the housing 114, only one outer contact 126 and one nose cone 130 is shown in FIG. 7. The tunnels 210 may have an elongated dome shape that resembles a longitudinal cross-section of a tube or pipe. The tunnels 210 are open along the bottom side 144 of the base panel 136. For example, the tunnels 210 may have convex cylindrical shapes that arc or bow away from the circuit board 104 such that an apex 214 of each tunnel 210 is disposed farther from the circuit board 104 than the location of edges 216 of the tunnel 210 relative to the circuit board 104. The tunnels 210 are configured to accommodate the curved shapes of the outer contacts 126. For example, the inner surface 208 of a respective tunnel 210 may engage the mounting segment 158 of a corresponding outer contact 126 that is at least partially within the tunnel 210.

In an embodiment, the tunnels 210 define tunnel slots 218 that extend through tunnel walls 220. The tunnel slots 218 extend from a rear end 222 of the respective tunnel 210 in a direction towards the front panel 134. The tunnel slots 218 may extend less than half of the length of the respective tunnel 210. In the illustrated embodiment, each of the two tunnels 210 defines two tunnel slots 218, with one tunnel slot 218 located on each side of the apex 214 of the tunnel 210 along the lateral width of the housing 114. The tunnel slots 218 are each configured to receive a grounding leg 204 of the outer contact 126 within the tunnel 210. For example, a grounding leg 204 may extend out of the tunnel 210 through one of the tunnel slots 218. A distal section 240 of the grounding leg 204 outside of the tunnel 210 may be mechanically coupled and/or electrically terminated to the circuit board 104. For example, the distal section 240 may be through-hole mounted in a corresponding via 242 of the circuit board 104. The through-hole mounting may serve a dual function of mechanically coupling the grounding leg 204 in order to secure the outer contact 126 to the circuit board 104 and also electrically terminating the grounding leg 204 to provide a grounding path between the outer contact 126 and the circuit board 104.

In the illustrated embodiment, the base panel 136 defines at least one mounting slot 224 associated with each tunnel 210. The mounting slots 224 extend through the base panel 136 between the top side 142 and the bottom side 144. The base panel 136 may include one mounting slot 224 on both lateral sides of a corresponding tunnel 210. The mounting slots 224 may extend from the rear end 222 of the base panel 136 towards the front panel 134, similarly to the tunnel slots 218. In an embodiment, the rear grounding legs 204B of a respective outer contact 126 are configured to extend through both the tunnel slots 218 and the mounting slots 224. For example, each rear grounding leg 204B includes the distal section 240 and a proximal section 246 that is located between the distal section 240 and the spine portion 206 of the outer contact 126. The spine portion 206 is disposed within a corresponding tunnel 210. The proximal section 246 of one grounding leg 204B extends out of the tunnel 210 through one of the tunnel slots 218, and the distal section 240 of the same grounding leg 204B extends downward through one of the mounting slots 224 in the base panel 136 in order to mount to the circuit board 104 (e.g., by being received in one of the vias 242).

In an embodiment, the locations of the tunnel slots 218 and mounting slots 224 along the base panel 136 define stub portions 248 of the tunnel walls 220. The stub portions 248 are cantilevered and extend to the rear end 222 of the base panel 136. In an embodiment, when an outer contact 126 is loaded in corresponding tunnel 210, the rear grounding legs 204B at least partially surround the stub portions 248. For example, a stub portion 248 may be disposed laterally between the distal section 240 of one grounding leg 204B and the spine portion 206 of the outer contact 126. Thus, the stub portion 248 may be located within the open bottom of the mounting segment 158 of the outer contact 126. The stub portions 248 optionally may be the only portions of the base panel 136 (including the tunnels 210) that are radially interior and/or at least partially surrounded by the outer contacts 126 held within the tunnels 210.

The rear grounding legs 204B extending through the tunnel slots 218 and the mounting slots 224 interlocks the outer contact 126 and the base panel 136, which structurally ties the outer contact 126 to the base panel 136. Thus, at least some forces exerted on the outer contact 126 may be transferred to the base panel 136. The base panel 136 is mounted to the circuit board 104 independently from the outer contact 126 via the mounting posts 118 being received in the corresponding holes 120 of the circuit board 104. Thus, the base panel 136 of the housing 114 structurally supports the mounting segment 158 of the outer contact 126 by mechanically engaging the outer contact 126 to reinforce the mounting of the outer contact 126 to the circuit board 104. Since the outer contact 126 may be stamped and formed in an embodiment, the structural support provided by the housing 114 and the nose cone 130 of the header assembly 102 may prohibit the outer contact 126 from damage caused by bending and/or twisting during mating and un-mating of the mating connector relative to the header assembly 102.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A header assembly comprising:

a housing composed of a dielectric material, the housing having a front panel including a front side and a rear side, the front panel defining a contact opening therethrough between the front side and the rear side, the housing also including a base panel extending from the rear side of the front panel and formed integral to the front panel, the base panel configured to mount to a circuit board;

an outer contact formed of an electrically conductive material, the outer contact including a mating segment and a mounting segment, the mating segment extending through the contact opening of the front panel and defining a cylindrically-shaped channel, the mounting segment disposed between the base panel and the circuit board and engaging the base panel along a length of the base panel, the mounting segment configured to mechanically couple and electrically terminate to the circuit board; and a center contact disposed in the channel of the outer contact.

2. The header assembly of claim 1, further comprising a nose cone coupled to the front panel and extending from the front side of the front panel, the nose cone defining a cavity that receives the mating segment of the outer contact therein such that the nose cone surrounds the mating segment, the nose cone having at least one keying rib along an exterior thereof.

3. The header assembly of claim 2, wherein the front panel defines at least one aperture through the front panel that is proximate to the contact opening, the nose cone having at least one lug extending from a back wall of the nose cone, each lug being received in a corresponding one of the apertures to couple the nose cone to the front panel.

4. The header assembly of claim 1, wherein the base panel of the housing includes mounting posts configured to extend into corresponding holes in the circuit board to mount the housing to the circuit board.

5. The header assembly of claim 1, wherein the housing includes at least one support wall extending between the front panel and the base panel.

6. The header assembly of claim 1, wherein the mounting segment of the outer contact has two rear grounding legs that extend from a spine portion of the outer contact, each rear grounding leg having a proximal section that extends generally laterally from the spine portion and a distal section that extends generally vertically towards the circuit board to mount to the circuit board, the rear grounding legs extending around corresponding stub portions of the base panel such that each stub portion is disposed laterally between the distal section of the corresponding rear grounding leg and the spine portion of the outer contact.

7. The header assembly of claim 1, wherein the base panel of the housing defines a tunnel that extends rearward from a front of the base panel at the front panel, the mounting segment of the outer contact being disposed within the tunnel and engaging an inner surface of the tunnel.

8. The header assembly of claim 7, wherein the tunnel has an elongated dome shape that is open along a bottom side of the base panel that faces the circuit board.

9. The header assembly of claim 7, wherein the tunnel defines two tunnel slots therethrough extending frontward from a rear end of the tunnel, the mounting segment of the outer contact having two rear grounding legs that extend outward from a spine portion of the outer contact, each rear grounding leg extending out of the tunnel through a corresponding one of the tunnel slots to mechanically couple and electrically terminate to the circuit board.

10. The header assembly of claim 1, wherein the mating segment of the outer contact has a closed cylindrical shape and the mounting segment of the outer contact has an open cylindrical shape, the mating segment formed integral to the mounting segment, the mounting segment including edges and grounding legs that extend from the edges to be received within vias of the circuit board.

11. A header assembly comprising:

a housing composed of a dielectric material, the housing having a front panel including a front side and a rear side, the front panel defining a contact opening therethrough between the front side and the rear side, the housing also including a base panel extending from the rear side of the front panel, the base panel defining a tunnel that extends rearward from a front of the base panel at the front panel, the base panel configured to mount to a circuit board, the tunnel having an elongated dome shape that is open along a bottom side of the base panel that faces the circuit board;

an outer contact formed of an electrically conductive material, the outer contact including a mating segment and a mounting segment, the mating segment extending through the contact opening of the front panel and defining a cylindrically-shaped channel, the mounting segment being disposed within the tunnel of the base panel between an inner surface of the tunnel and the circuit board, the mounting segment configured to mechanically couple and electrically terminate to the circuit board; and a center contact disposed in the channel of the outer contact.

12. The header assembly of claim 11, wherein the tunnel defines two tunnel slots therethrough, the mounting segment of the outer contact having two rear grounding legs that extend outward from a spine portion of the outer contact, each rear grounding leg extending from the tunnel through a corresponding one of the tunnel slots to mechanically couple and electrically terminate to the circuit board.

13. The header assembly of claim 12, wherein the base panel includes a top side and a bottom side that faces the circuit board, the base panel defining a mounting slot on both a first side and a second side of the tunnel along a lateral width of the housing, each mounting slot extending through the base panel between the top side and the bottom side, wherein each rear grounding leg of the outer contact has a proximal section that extends out of the tunnel through the corresponding tunnel slot and a distal section that extends downward through a corresponding mounting slot in the base panel to mount to the circuit board such that at least a stub portion of the base panel is disposed laterally between the distal section of the rear grounding leg and the spine portion of the outer contact.

14. The header assembly of claim 11, wherein the outer contact is a first outer contact and the contact opening of the front panel is a first contact opening, the header assembly further including a second outer contact, the front panel further defining a second contact opening disposed adjacent to the first contact opening along a lateral width of the housing, the second outer contact having a mating segment extending through the second contact opening and a mounting segment disposed between the base panel of the housing and the circuit board, the mounting segment of the second outer contact configured to mechanically couple and electrically terminate to the circuit board.

15. A header assembly comprising:

a housing composed of a dielectric material, the housing having a front panel including a front side and a rear side, the front panel defining a contact opening therethrough between the front side and the rear side, the front panel defining at least one aperture therethrough that is proximate to the contact opening, the housing also including a base panel extending from the rear side of the front panel, the base panel configured to mount to a circuit board;

a nose cone coupled to the front panel and extending from the front side of the front panel along a mating axis, the nose cone defining a cavity that aligns with and is open to the contact opening, the nose cone defining a mating interface for receiving a mating connector within the cavity in a loading direction along the mating axis, the nose cone having at least one keying rib along an exterior thereof, the nose cone having at least one lug extending from a back wall of the nose cone, each lug being received in a corresponding aperture of the at least one aperture of the front panel to removably couple the nose cone to the front panel; and an outer contact formed of an electrically conductive material, the outer contact extending longitudinally from a mating segment to a mounting segment, the mating segment being disposed within the cavity of the nose cone and extending through the contact opening of the front panel, the mounting segment disposed rearward of the front panel and located between the base panel and the circuit board, the mounting segment configured to mechanically couple and electrically terminate to the circuit board.

16. The header assembly of claim 15, wherein the nose cone includes an annular shoulder within the cavity that defines a reduced-diameter portion of the cavity, the mating segment of the outer contact extending through the annular shoulder, an interior surface of the annular shoulder surrounding the mating segment and configured to engage an exterior surface of the mating segment to prohibit deformation of the outer contact.

17. The header assembly of claim 15, further comprising an electromagnetic interference (EMI) shield disposed between the front panel and the nose cone, the EMI shield engaging the mating segment of the outer contact to electrically connect the EMI shield to the outer contact.

18. The header assembly of claim 15, wherein the base panel of the housing defines a tunnel that extends rearward from the front panel, the tunnel having an elongated dome shape that is open along a bottom side of the base panel that faces the circuit board, the mounting segment of the outer contact being disposed within the tunnel and engaging an inner surface of the tunnel.

19. The header assembly of claim 15, wherein the base panel of the housing defines a tunnel that extends rearward from the front panel, the tunnel defining two tunnel slots therethrough extending frontward from a rear end of the tunnel, the mounting segment of the outer contact having two rear grounding legs that extend outward from a spine portion of the outer contact, each rear grounding leg extending out of the tunnel through a corresponding one of the tunnel slots to mechanically couple and electrically terminate to the circuit board.

20. The header assembly of claim 15, wherein the mounting segment of the outer contact has two rear grounding legs that extend from a spine portion of the outer contact, the rear grounding legs extending around corresponding stub portions of the base panel such that each stub portion is disposed laterally between a distal section of the corresponding rear grounding leg and the spine portion of the outer contact.

* * * * *